US006745664B2

(12) United States Patent
Kopkie

(10) Patent No.: US 6,745,664 B2
(45) Date of Patent: Jun. 8, 2004

(54) PAINT SHAKER AND MOTOR THEREFOR

(76) Inventor: Harold D. Kopkie, 27331 NE. 69th Ave., Battle Ground, WA (US) 98604

( * ) Notice: Subject to any disclaimer, the term of this patent is extended or adjusted under 35 U.S.C. 154(b) by 122 days.

(21) Appl. No.: 10/001,775

(22) Filed: Nov. 13, 2001

(65) Prior Publication Data

US 2002/0039327 A1 Apr. 4, 2002

(51) Int. Cl.[7] ..... F01B 1/01; B01F 11/00

(52) U.S. Cl. ..... 91/49; 91/224; 366/215; 366/605

(58) Field of Search ..... 366/209–212, 366/215, 216, 237–240, 605; 91/49, 224, 226

(56) References Cited

U.S. PATENT DOCUMENTS

| | | | | | |
|---|---|---|---|---|---|
| 842,049 | A | * | 1/1907 | Wolski | 173/73 |
| 2,345,024 | A | * | 3/1944 | Bannister | 173/31 |
| 3,236,157 | A | * | 2/1966 | Lovell et al. | 91/224 |
| 3,301,534 | A | | 1/1967 | Orser | |
| 3,331,588 | A | * | 7/1967 | Nasser | 366/211 |
| 3,415,495 | A | | 12/1968 | Grubelic | |
| 3,480,259 | A | * | 11/1969 | Schletz | 366/211 |
| 4,662,760 | A | | 5/1987 | Powell | |
| 4,893,938 | A | | 1/1990 | Anderson | |
| 5,050,996 | A | | 9/1991 | Allen | |

FOREIGN PATENT DOCUMENTS

FR 2468004 A * 5/1981

* cited by examiner

*Primary Examiner*—Charles E. Cooley
*Assistant Examiner*—David L. Sorkin
(74) *Attorney, Agent, or Firm*—Birdwell & Janke, LLP

(57) ABSTRACT

A paint shaker and motor therefor. A yoke has at a first end a clamp for clamping a paint can and at a second end, is pivotally connected to a linkage assembly that converts the linear motion of a reciprocating linear motor to an arcing motion of the yoke. The motor includes a cylinder and a piston that is spring biased toward an inlet end of the cylinder. Compressed air enters the inlet end and a passageway through the piston for conducting the compressed air to a valve having a displaceable stopper, wherein the compressed air seats the stopper in the valve and thereby closes the valve, so that air pressure moves the piston toward an outlet end of the cylinder. The outlet end of the cylinder includes a projection against which the piston drives the stopper so as to unseat the stopper in the valve and thereby open the valve, permitting the spring bias to return the piston toward the inlet end of the cylinder.

2 Claims, 2 Drawing Sheets

PAINT SHAKER AND MOTOR THEREFOR

BACKGROUND OF THE INVENTION

The present invention relates to a paint shaker and motor therefor, particularly a paint shaker for light duty use powered by a single-action compressed-air driven motor.

Powell, U.S. Pat. No. 4,662,760, indicates that prior pneumatically driven paint shaking machines had typically been powered by single-acting air cylinder motors. It was noted that these machines had shown inadequacies in mixing metallic paints, while the more powerful, electric motor driven paint shakers had been heavy, bulky and expensive, and have the important disadvantage of being relatively unsafe in environments where combustible materials or gases are present. There has been an increasing use of metallic paints, which are difficult to mix, as the metallic elements tend to settle out relatively quickly. Another problem noted in Powell with single-action pneumatic machines is that they are generally not suitable for higher speed operation, due to problems with the valving arrangements.

As a result of these deficiencies with single-action compressed-air driven motors, Powell proposes a paint shaker employing a double-acting air driven motor controlled by a differential pressure actuated by a bistable valve assembly. However, double-action motors require at least additional machining and complexity in the cylinder and piston assembly, increasing cost and potentially decreasing reliability and durability.

The prior art in paint shakers does not point directly to an optimum motion to impart to a paint can for mixing paint. Powell and Allen, U.S. Pat. No. 5,050,996 both specifically recognize the difficulty of mixing metallic paints in particular, and teach producing an oscillatory motion about a vertical axis that extends through the paint can being shaken. However, the present inventor has recognized that such motion inevitably leaves "dead spots" proximate this axis where mixing is diminished or nonexistent. Grubelic, U.S. Pat. No. 3,415,495 proposes producing a rocking motion about a horizontal axis that is located outside but still very close to the can, so that there remain areas near this axis where mixing is substantially diminished with respect to other areas. Moreover, Grubelic is silent regarding how to effectively mix metallic paint. Anderson, U.S. Pat. No. 4,893,938 proposes a more complex, compound motion that includes oscillation about a horizontal axis specifically for shaking a nail polish container.

Accordingly, there is a need for a paint shaker and motor therefor that provides the low cost, reliability, durability and safety advantages of the single-action pneumatic motors combined with a mechanism for optimally mixing paint at high speed, especially metallic paint.

SUMMARY OF THE INVENTION

The paint shaker and motor therefor of the present invention solves the aforementioned problems and meets the aforementioned need by providing a yoke having at a first end a clamp for clamping a paint can and adapted at an opposite, second end for pivotal connection to a first end of a linkage assembly for coupling the yoke to an exposed end of a linear reciprocating motor that linearly reciprocates the exposed end along a first axis. The linkage assembly converts the linear motion of the exposed end of the motor to an arcing motion. The yoke is pivotally mounted with respect to the motor so that moving the second end of the yoke along an arc also moves the first end of the yoke along a corresponding arc.

The motor includes a piston slidingly disposed in a cylinder, the piston being pivotally connected to a second end of the linkage assembly. The piston is spring biased in the cylinder toward an inlet end thereof. The cylinder includes an air inlet, for letting compressed air into the inlet end thereof, and the piston includes a passageway for ducting the compressed air to a valve having a displace able stopper, wherein the compressed air seats the stopper in the valve and thereby closes the valve. At an outlet end of the cylinder, the cylinder includes an air outlet for permitting compressed air passing the valve to exit the cylinder. The outlet end of the cylinder includes a projection against which the piston, moving toward the outlet end of the cylinder, drives the stopper so as to unseat the stopper in the valve and thereby open the valve, permitting the spring bias to return the piston toward the inlet end of the cylinder.

Therefore, it is a principal object of the present invention to provide a novel and improved paint shaker and motor therefor.

It is another object of the present invention to provide a paint shaker and motor therefor that provides the low cost, reliability, durability and safety advantages of single-action pneumatic motors.

It is still another object of the present invention to provide such a paint shaker that provides for high speed operation.

It is yet another object of the present invention to provide such a paint shaker that provides for optimally mixing the paint.

It is a further object of the present invention to provide such a paint shaker that is optimum for mixing metallic paint.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
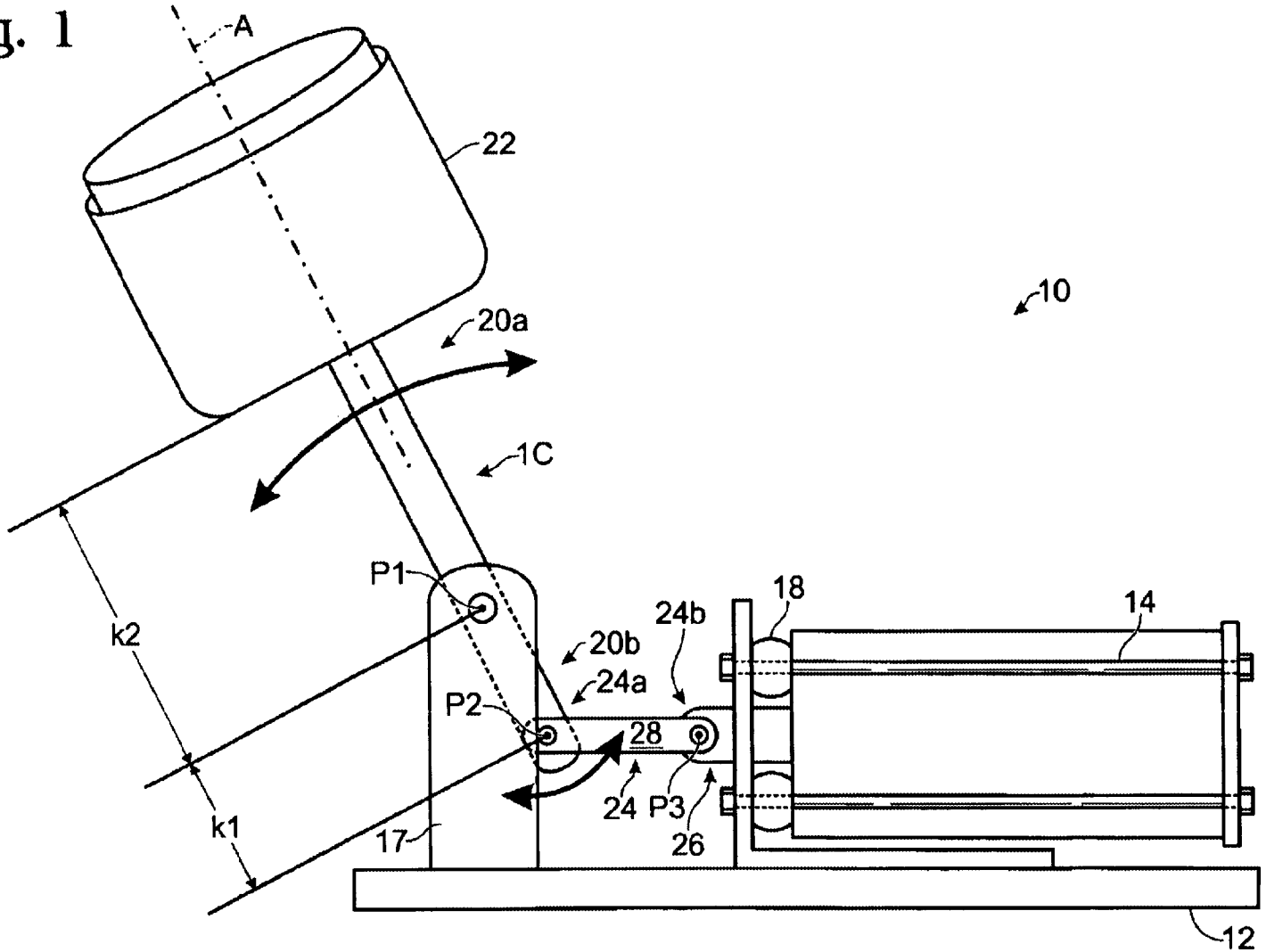
FIG. 1 is a side elevation of a paint shaker and motor therefor, according to the present invention.

Referring to FIG. 1, a paint shaker 10 according to the present invention is shown. The paint shaker has a base 12 that supports a linear reciprocating motor 14 and a yoke 16 adapted for oscillatory reciprocating motion about a pivot point "P1" that is fixedly maintained with respect to the motor, such as by the use of stand-offs 17 attached to the base. The motor is preferably mounted to the base by way of isolating mounts 18 formed of rubber or other suitably compliant material. It is believed that an advantage is obtained by mounting the motor to the base with the isolating mounts 18 at an inlet end of the motor, which is described below.

The yoke 16 has an upper end 20*a* and a lower end 20*b*. Attached to the upper end 20*a* is a clamp 22 for clamping a paint can. The clamp 22 is not shown with any specificity because any prior art can clamping mechanism may be employed without departing from the principles of the invention, examples being shown in Allen, U.S. Pat. No. 5,050,996, and Anderson, U.S. Pat. No. 4,893,938. The can may be clamped so that its cylindrical axis is aligned with an elongate axis "A" of the yoke or it may be at an angle with respect to the axis "A," including a 90 degree angle.

Attached to the lower end 20*b* of the yoke 16 is one end 24*a* of a linkage assembly 24; the other end 24*b* of the linkage assembly is attached to a linearly reciprocating exposed end 26 of the motor 14. The linkage assembly converts the linear motion of the exposed end 26 to an arcing motion of the lower end 20*b*, both motions being indicated by arrows in FIG. 1. To provide this motion, the linkage assembly 24 preferably comprises a rigid link member 28 that is pivotally mounted at a point of attachment "P2" to the lower end 20*b* of the yoke and at point "P3" to the exposed end 26 of the motor; however, other configurations of the linkage assembly providing the same motion may be employed without departing from the principles of the invention.

While the point of attachment "P2" is shown in the preferred embodiment of the invention at one end of the yoke with the pivot point "P1" for pivoting the yoke being disposed between the ends, so that the upper and lower ends of the yoke swing in opposite directions, the yoke may as well be pivoted about its lower end 20*b* and be coupled to the motor at a point of attachment "P2" that is between the lower and upper ends. However, preferably, the distance "k1" between the pivot point "P1" of the yoke and the point of attachment "P2" of the yoke to the linkage assembly is less than the distance "k2" between the pivot point "P1" of the yoke and any point within the paint can. This provides a mechanical advantage, i.e., the ratio "k2/k1," for shaking the paint that can be beneficial for thorough mixing of metallic paint.

Figure 2:
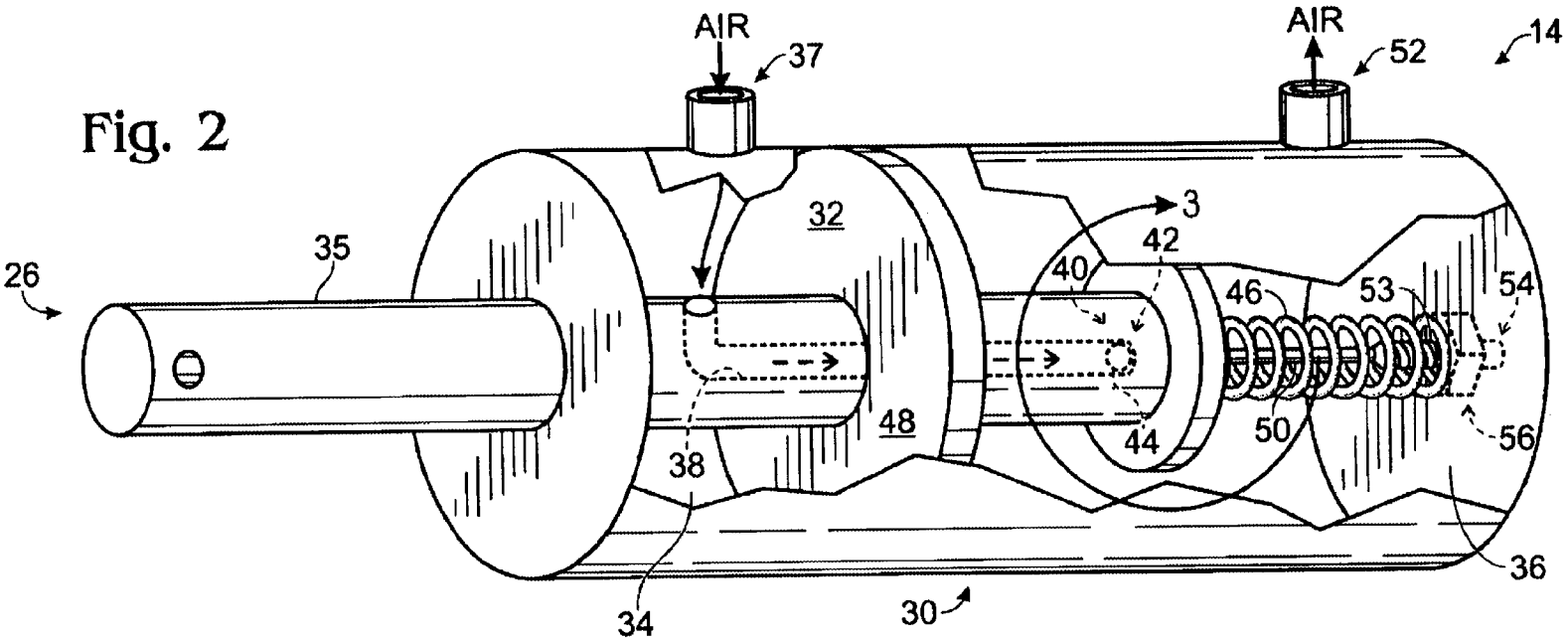
FIG. 2 is a partially cut-away, pictorial view of a motor for a paint shaker according to the present invention.

Turning to FIG. 2, a preferred motor 14 according to the invention for use with the paint shaker 10 is shown in greater detail. The motor 14 comprises a cylinder 30 enclosing a slidable piston 32. The cylinder has an inlet end 34 and an outlet end 36, the two ends being separated from one another by the piston 32. A compression spring 46 biases the piston toward the inlet end of the cylinder. The motor is powered by compressed air, which may be supplied by any prior art compressor.

A rod 34 extends through the inlet end of the cylinder, so that an exposed end 26 is available for coupling to the yoke 16 as described above; however, the rod could be adapted to extend through the outlet end and the orientation of the motor reversed without departing from the principles of the invention.

The inlet end 34 of the cylinder 30 is substantially airtight, except for the provision of an air inlet 37 for receiving the compressed air for driving the motor, and a passageway 38 extending through the piston 32 and into the outlet end of the cylinder. This passageway is blocked by a valve 40 having a seat 42 and a displace able stopper 44 adapted to be sealingly received by the seat, the valve 40 being shown magnified in FIG. 3 for greater clarity. Compressed air introduced into the inlet end of the cylinder rushes into the passageway to exert a pressure on the stopper 44, seating the stopper and thereby closing the valve. This permits air pressure to rise against an inlet face 48 of the piston, driving the piston toward the outlet end of the cylinder with a linear motion.

Figure 3:
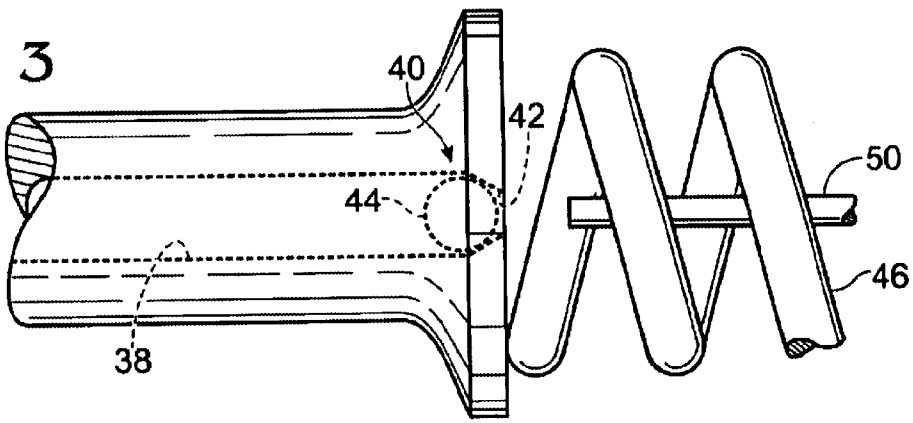
FIG. 3 is a magnified view of a detail indicated in FIG. 2.

The outlet end 36 of the cylinder 30 includes a projection 50 adapted to unseat the stopper when the piston has moved in the direction of the outlet end past a predetermined amount. This feature is also seen in FIG. 3. As the valve 40 is moved to the right in FIG. 2, the stopper 44 ultimately hits the end of the projection 50, and any further movement of the valve 40 to the right unseats the stopper. This permits the compressed air to flow past the seat 42 and out an air outlet 52 of the outlet end of the cylinder 30. As the pressure in the inlet end of the cylinder 30 decreases, the spring 46 eventually becomes capable of overcoming this pressure and moves the piston back toward the inlet end, thereby reciprocating the linear motion of the piston.

It is believed that the valve 40 is particularly inexpensive to implement as opposed to alternative valving arrangements, and it is also believed to provide for a particularly durable single-action motor capable of high speed operation that is especially beneficial for mixing metallic paint.

Preferably, the projection 50 is axially adjustable, i.e., adjustable along the axis of movement of the piston, such as by having a threaded end 54 that is received in a corresponding threaded hole 53 in the outlet end of the cylinder, the threaded end being locked in axial position by a nut 56 that may be on either side the wall of the outlet end 52, but that is preferably on the outside of the wall to provide ready access to the nut. Adjusting the axial position of the projection 50, by loosening the nut 56, threading or unthreading the projection 50 in the hole 53, and tightening the nut 56 to hold the projection in position, adjusts the point at which the stopper is unseated, which adjusts the stroke and, therefore, the speed of the engine.

It is to be recognized that, while a paint shaker and motor therefor has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. A motor for a paint shaker, comprising:

a cylinder having an inlet end and an outlet end, said inlet end having an air inlet for receiving compressed air and being otherwise substantially air-tight, said outlet end being adapted for exhausting the compressed air;

a piston slidingly disposed in said cylinder;

a compression spring for biasing said piston toward said inlet end of said cylinder, said piston including a valve defining an air outlet of said piston, said valve comprising a displaceable stopper and an associated valve seat, wherein said piston includes a passageway for conducting the compressed air from said air inlet of said cylinder to said valve, wherein said stopper is adapted to seat against said valve seat in response thereto and thereby to close said valve, wherein said cylinder includes a member adapted to unseat said stopper and thereby to allow the compressed air to enter said outlet end of said cylinder from said passageway when said piston moves toward said outlet end so that said stopper reaches a predetermined point of contact with said member.

2. The motor of claim 1, wherein said member is a projection supported by the outlet end of said cylinder.

* * * * *